US005292997A

United States Patent [19]

Kato et al.

[11] Patent Number: 5,292,997

[45] Date of Patent: Mar. 8, 1994

[54] TOUCH RESPONSIVE ENVELOPE SHAPE GENERATION DEVICE

[75] Inventors: Mitsumi Kato; Yasuhiro Kawano, both of Hamamatsu, Japan

[73] Assignee: Yamaha Corporation, Hamamatsu, Japan

[21] Appl. No.: 568,675

[22] Filed: Aug. 16, 1990

[30] Foreign Application Priority Data

Aug. 17, 1989 [JP] Japan ..... 1-212558
Aug. 17, 1989 [JP] Japan ..... 1-212559

[51] Int. Cl.[5] ..... G10H 1/057

[52] U.S. Cl. ..... 84/627

[58] Field of Search ..... 84/601, 602, 627, 604, 84/627, 629, 663, 702, 615, 626, 658, 687-690

[56] References Cited

U.S. PATENT DOCUMENTS

| | | | |
|---|---|---|---|
| 4,067,253 | 1/1978 | Wheelwright et al. | 84/687 |
| 4,077,294 | 3/1978 | Hiyoshi et al. | 84/627 |
| 4,440,056 | 4/1984 | Kozuki et al. | 84/627 |
| 4,535,669 | 8/1985 | Kaneko | 84/627 |
| 4,655,114 | 4/1987 | Sunada | 84/627 |
| 4,794,837 | 1/1989 | Katoh | 84/607 |
| 4,893,538 | 1/1990 | Masaki et al. | 84/605 |
| 4,909,121 | 3/1990 | Usa et al. | 84/627 |

*Primary Examiner*—Stanley J. Witkowski
*Attorney, Agent, or Firm*—Graham & James

[57] ABSTRACT

An envelope shape generation device includes an envelope shape memory storing envelope shape data, a touch information generation circuit for generating touch information, an envelope shape data reading circuit for reading out the envelope shape data prestored in the envelope shape memory in response to the touch information to form an envelope shape signal. The envelope shape reading circuit includes a first envelope reading circuit for reading out a waveform section from an attack portion to a portion immediately before starting of a release envelope shape in response to key-on information and a second envelope shape reading circuit for reading out a release envelope shape following the waveform section read by a first envelope reading circuit in response to key-off information, and a release envelope correction circuit for correcting a head value of the read out release envelope shape to agree with the read out envelope shape value of the first envelope shape section so that the second envelope shape section is connected smoothly to the first envelope shape section.

6 Claims, 9 Drawing Sheets

GENERATION OF ENVELOPE SHAPE

| SELECTION MODE | AD | | OUT |
|---|---|---|---|
| | $V_1$ | $V_0$ | |
| ATTACK MODE | 0 | 0 | I 0 |
| LOOP MODE | 0 | 1 | I 1 |
| RELEASE MODE | 1 | 0 | I 2 |

| SELECTION MODE | SEL | | OUT |
|---|---|---|---|
| | $V_{11}$ | $V_{10}$ | |
| HOLD MODE | 0 | 0 | I 10 |
| STEPPING MODE | 0 | 1 | I 11 |
| RETURN MODE | 1 | 0 | I 12 |
| RESET MODE | 1 | 1 | I 13 |

| SELECTION MODE | CON | | OUT |
|---|---|---|---|
| | KOFP | KONP | |
| HOLD MODE | 0 | 0 | I 20 |
| RESET MODE | 0 | 1 | I 22 |
| LOAD MOAD | 1 | 0 | I 21 |
| NON-OPERATION MODE | 1 | 1 | X |

TOUCH RESPONSIVE ENVELOPE SHAPE GENERATION DEVICE

BACKGROUND OF THE INVENTION

This invention relates to an envelope shape generation device in an electronic musical instrument and, more particularly, to an envelope shape generation device of an envelope shape memory system type.

In the art of envelope shape generation device, there have been proposed and used envelope shape generation devices of an envelope shape memory system type which prestore sampling shape values of envelope shapes as envelope shape data in envelope shape memories and these envelope shape data are read out in accordance with key-on and key-off operations.

These prior art envelope shape generation devices employ a tone color selection signal for reading out envelope shapes but it has been felt that these prior art devices are insufficient in naturalness of a tone produced.

When a natural musical instrument is played with, for example, a vibrato performance technique, there occurs the phenomenon that the envelope of a tone generated subtly changes in response to strength of the vibrato performance. In the prior art envelope shape generation devices, however, an envelope shape simulating such envelope of a natural musical instrument cannot be obtained.

It is, therefore, an object of the invention to provide an envelope shape generation device capable of generating a tone signal having an improved naturalness with a simple construction.

In the prior art envelope shape generation devices of the envelope shape memory system type, elements constituting respective portions of an envelope shape, i.e., an attack shape portion, loop shape portion and release shape portion etc., are stored in an envelope shape memory. Attack shape data of the attack shape portion is read out only once when a key-on operation has been made, then loop shape data of the loop shape portion is repeatedly read out until a key-off operation is made, and, when the key-off operation has been made, release shape data of the release shape portion is read out only once thereby to fade out the tone in accordance with the release shape.

In forming an envelope shape by these envelope shape generation devices, in the stage of reading loop shape data repeatedly by continuing a key-on operation, a key-off operation is made at any desired time point regardless of the state of reading of the loop shape data. This means that the reading of the loop shape is finished at any unexpected value within a range in which contents of the loop shape data and, therefore, an instantaneous value of the envelope shape, change during the key-on operation and, simultaneously, reading of the release shape is started.

For generating a release envelope shape from any value of a changing envelope value, it is conceivable to cause a head value of a release shape to agree with a mean value of a loop shape thereby to reduce discontinuity occurring in switching from the loop shape to the release shape. It is also conceivable to simply determine a head value of a release shape in correspondence to a fixed envelope shape value at the end of the loop shape data.

The former method, however, has the problem that a tremendous amount of data is required as release shape data. The latter method has the problem that a smooth connection of the envelope shape cannot be expected.

It is, therefore, another object of the invention to provide an envelope shape generation device which, in generating an envelope shape data having an improved naturalness, can always connect a loop shape and a release shape together smoothly by merely prestoring data for only one envelope shape as release shape data.

SUMMARY OF THE INVENTION

For achieving the first described object of the invention, the envelope shape generation device of the envelope shape memory system according to the invention generates a tone signal having an improved naturalness by reading out envelope shape data in response to touch information.

The envelope shape generation device according to the invention comprises an envelope shape memory prestoring envelope shape data, touch information generation means for generating touch information, and envelope shape data reading means for reading out the envelope shape data prestored in the envelope shape memory in response to the touch information generated by the touch information generation means to form an envelope shape signal.

According to the invention, since touch information is used as a condition for reading out envelope shape data from the envelope shape memory, an envelope which subtly changes in response to a touch performance operation such as vibrato can be imparted to a tone signal and a tone signal having an improved naturalness can be generated with a very simple construction.

For achieving the second object of the invention, the envelope shape generation device according to the invention corrects a head value of a release shape to agree with an envelope shape value of a preceding envelope shape section at a key-off time and thereby obtains a smooth connection between the preceding envelope shape and the release shape.

In the envelope shape generation device according to this aspect of the invention, the reading means comprises first envelope shape reading means for reading out a first envelope shape section from an attack envelope shape to an envelope shape value immediately before starting of a release envelope shape in response to key-on information, and second envelope shape reading means for reading out a second envelope shape section consisting of a release envelope shape following the first envelope shape section in response to key-off information, and the envelope shape generation device further comprises release envelope correction means for correcting a head value of the release envelope shape having been read out by the second envelope shape reading means to agree with the envelope shape value having been read out by the first envelope shape reading means thereby to connect the second envelope shape section smoothly to the first envelope shape section.

According to this aspect of the invention, in reading out release envelope data from the envelope shape memory to provide the read out data as an envelope shape signal, a head value of the release shape is corrected to agree with an envelope shape value of a preceding envelope shape section and a smooth connection between the preceding envelope shape section and the release shape can thereby be provided regardless of an envelope shape value at which the preceding envelope shape section ends. Accordingly, data for one envelope shape has only to be prestored as the release envelope data and therefore the construction of the envelope shape generation device can be simplified.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

An embodiment of the invention will now be described.

[1] Entire construction of the electronic musical instrument

Figure 1:
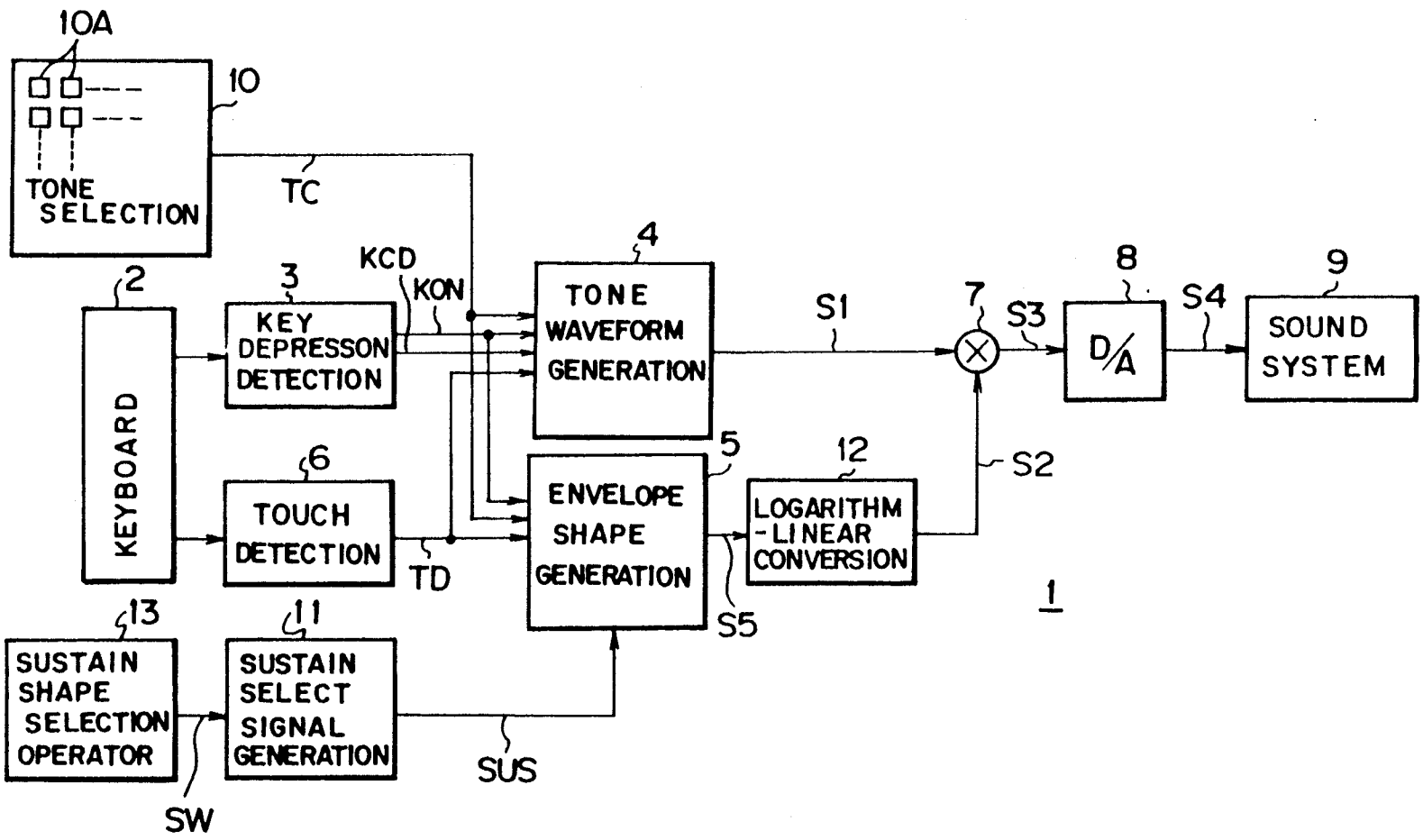
FIG. 1 is a block diagram showing an entire structure of an electronic musical instrument incorporating the envelope shape generation device according to the invention.
Figure 2:
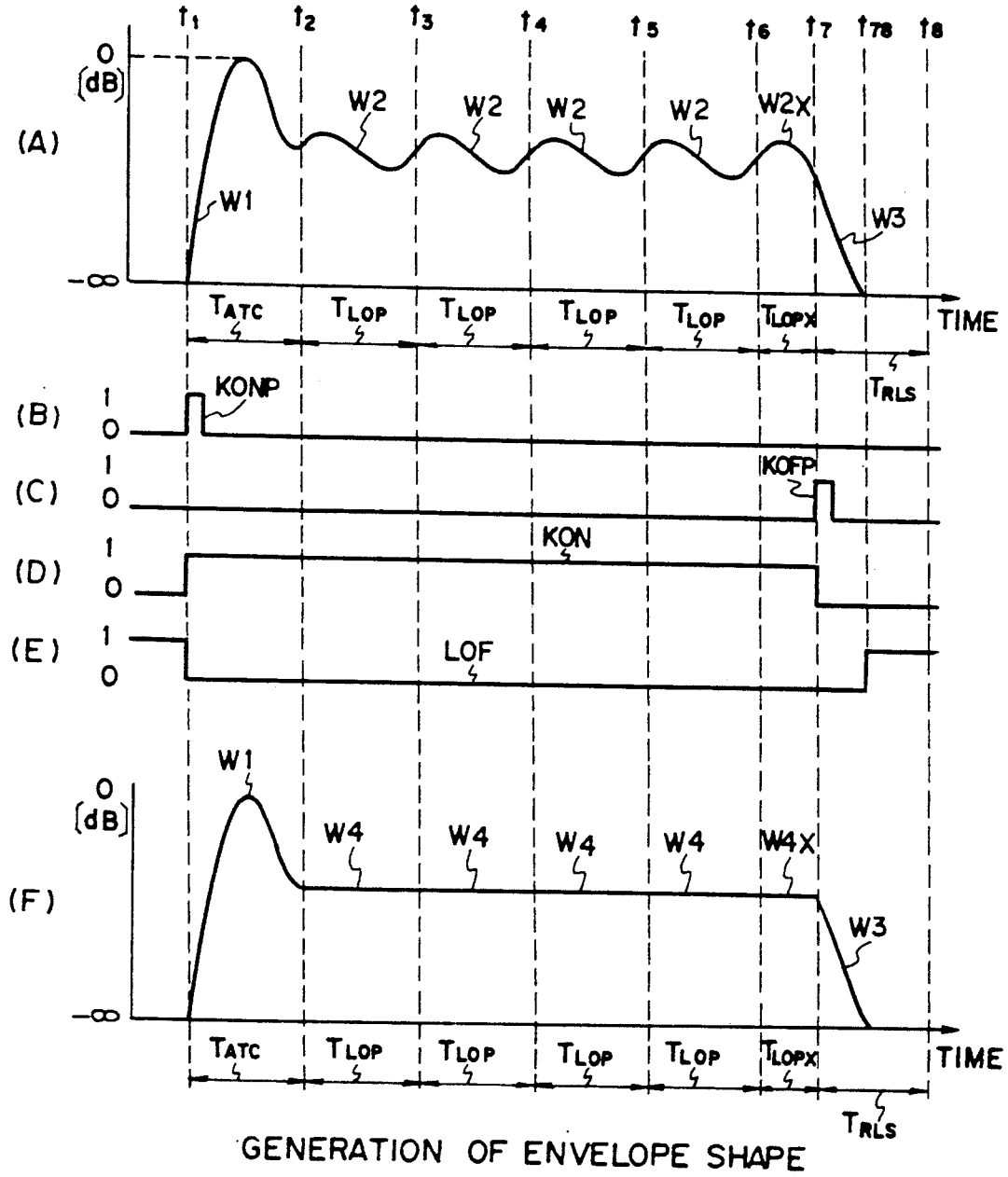
FIG. 2 is a waveform diagram for describing envelope shapes to be generated by an envelope shape generation circuit 5.

Referring to FIG. 1, when a key of a keyboard 2 in an electronic musical instrument 1 has been depressed at a time point t1 in FIG. 2, this is detected by a key depression detection circuit 3 which thereupon supplies a key-on signal KON (FIG. 2(D)) rising to "1" to a tone waveform generation circuit 4 and an envelope shape generation circuit 5 and supplies also a key code signal KCD representing the key code of the depressed key to the tone signal generation circuit 4.

When an initial touch operation has been made on the depressed key in the keyboard 2, a touch detection circuit 6 detects this and supplies corresponding touch data TD to the tone waveform generation circuit 4 and the envelope shape generation circuit 5.

The tone waveform generation circuit 4 supplies to a multiplication circuit 7 a tone waveform signal S1 which is equivalent to a signal obtained by modifying a tone having a tone pitch corresponding to the key code KCD in pitch in response to the touch data TD. The multiplication circuit 7 multiplies the tone waveform signal S1 with an envelope coefficient signal S2 and provides the result of the multiplication as tone signal data S3 to a digital-to-analog conversion circuit 8. An analog tone signal S4 thus obtained from the digital-to-analog conversion circuit 8 is supplied to a sound system 9 from which a tone based on the tone signal S4 is generated.

Figure 3:
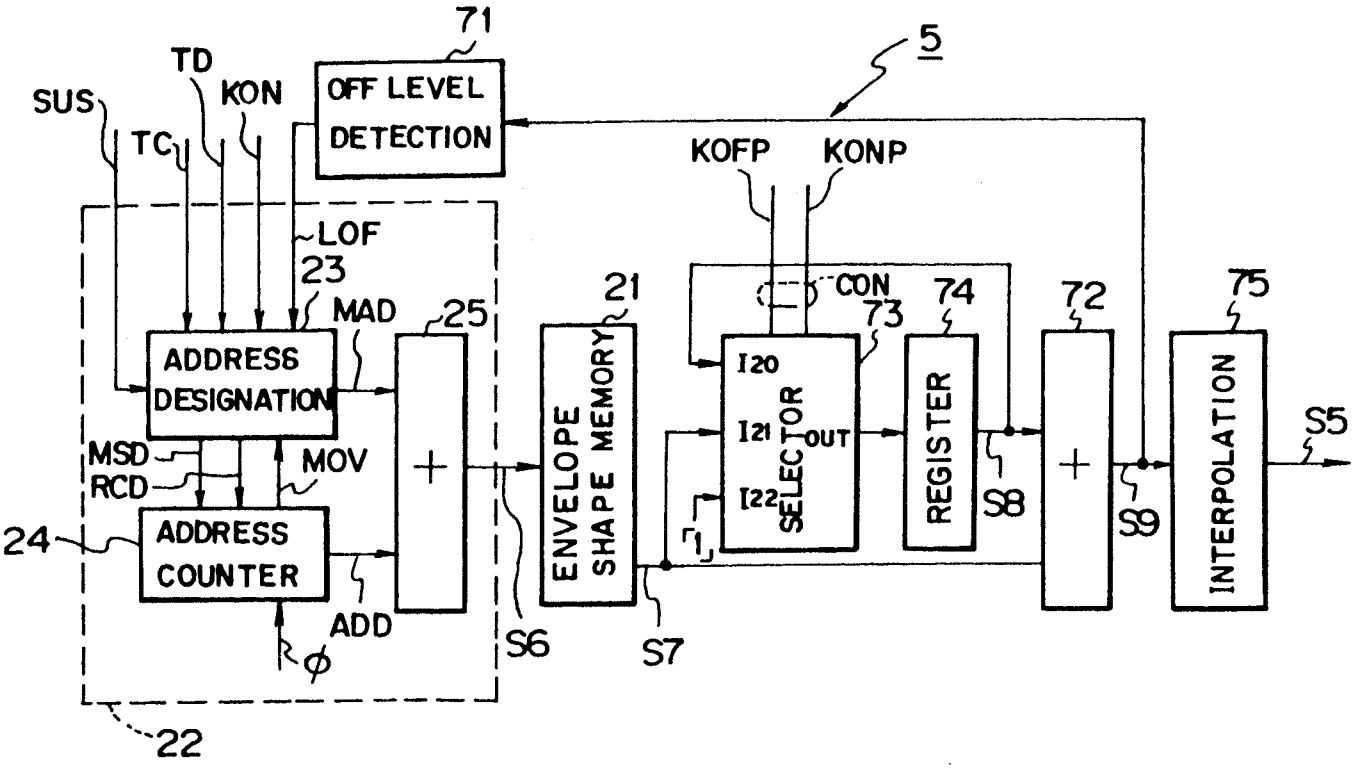
FIG. 3 is a block diagram showing a specific example of the envelope shape generation circuit 5 of FIG. 1.

The envelope shape generation circuit 5 includes, as shown in FIG. 3, an envelope shape memory 21 storing envelope shape data. By sequentially reading out envelope shape data prestored in the envelope shape memory 21 by an address signal formed inside of the device in response to the touch data TD supplied from the key depression detection circuit 3 and the touch detection circuit 6, key-on signal KON, tone color selection signal TC obtained by operating a tone color selection operator 10A in a tone color selection circuit 10, and a sustain select signal SUS supplied from a sustain select signal generation circuit 11, an envelope shape signal S5 is generated and this signal S5 is supplied to the multiplication circuit 7 through a logarithm/linear conversion circuit 12. Thus, tone signal data S3 imparted with an envelope shape is obtained by multiplying the tone waveform signal S1 with the coefficient signal S2.

In this embodiment, the envelope shape generation circuit 5 can generate two types of envelope shape such as shown as (A) and (F) in FIG. 2 as a sustain envelope shape following an attack envelope shape. When a player has caused a sustain select signal SUS of a level "1" (or "0") to be generated by operating the sustain shape selection operator 13, the envelope shape generation circuit 5 generates the envelope shape signal S5 having a loop sustain shape shown in FIG. 2(A) (or a fixed sustain shape shown in FIG. 2(F)).

In the case of the first envelope shape having the loop sustain shape shown in FIG. 2(A), the envelope shape generation circuit 5 forms an attack shape W1 during a predetermined attack time $T_{ATC}$ when a key-on operation has been made at a time point t1. When generation of the attack shape W1 has finished at a time point t2, the envelope shape generation circuit 5 forms a loop shape W2 during a predetermined loop period $T_{LOP}$ and repeatedly forms the loop shape W2 at a time point t3 at which generation of one loop shape W2 has finished. In this manner, the envelope shape generation circuit 5 repeatedly reads out the same loop shape W2 while the player continues the key-on operation.

When a key-off operation has been made at a time point t7, reading of the loop shape W2 which was started from a time point t6 finishes by finishing of the loop shape reading time at the key-off time point t6 and reading of a release shape W3 starts following the loop shape W2 which has been read out till then. As a result, the envelope shape generation circuit 5 reads out the release shape W3 only once during a release shape reading time $T_{RLS}$ and finishes reading of all envelope shape at a time point t8 which is the end time point of reading of the release shape W3.

In the case of the second envelope shape having the fixed sustain shape shown in FIG. 2(F), the envelope shape generation circuit 5 generates, after finishing reading of the attack shape W1, fixed shapes W4 and W4X having a constant shape value during subsequent loop shape reading periods $T_{LOP}$ and $T_{LOPX}$ and, thereafter, generates the release shape W3 at the key-off time t7.

[2] Envelope shape generation circuit

The envelope shape generation circuit 5 forms, as shown in FIG. 3, an address signal S6 for the envelope shape memory 21 in an address forming circuit 22. The address forming circuit 22 includes an address designation circuit 23 and an address counter 24. From the address designation circuit 23 is provided memory address data MAD designating a head address of a memory area prestoring a set of envelope shape data. From the address counter 24 is provided address stepping data ADD which increments by one address in response to a clock signal $\phi$. These data MAD and ADD are added together by an addition circuit 25 and result of the addition is supplied as an address signal S6 to the envelope shape memory 21.

Figure 4:
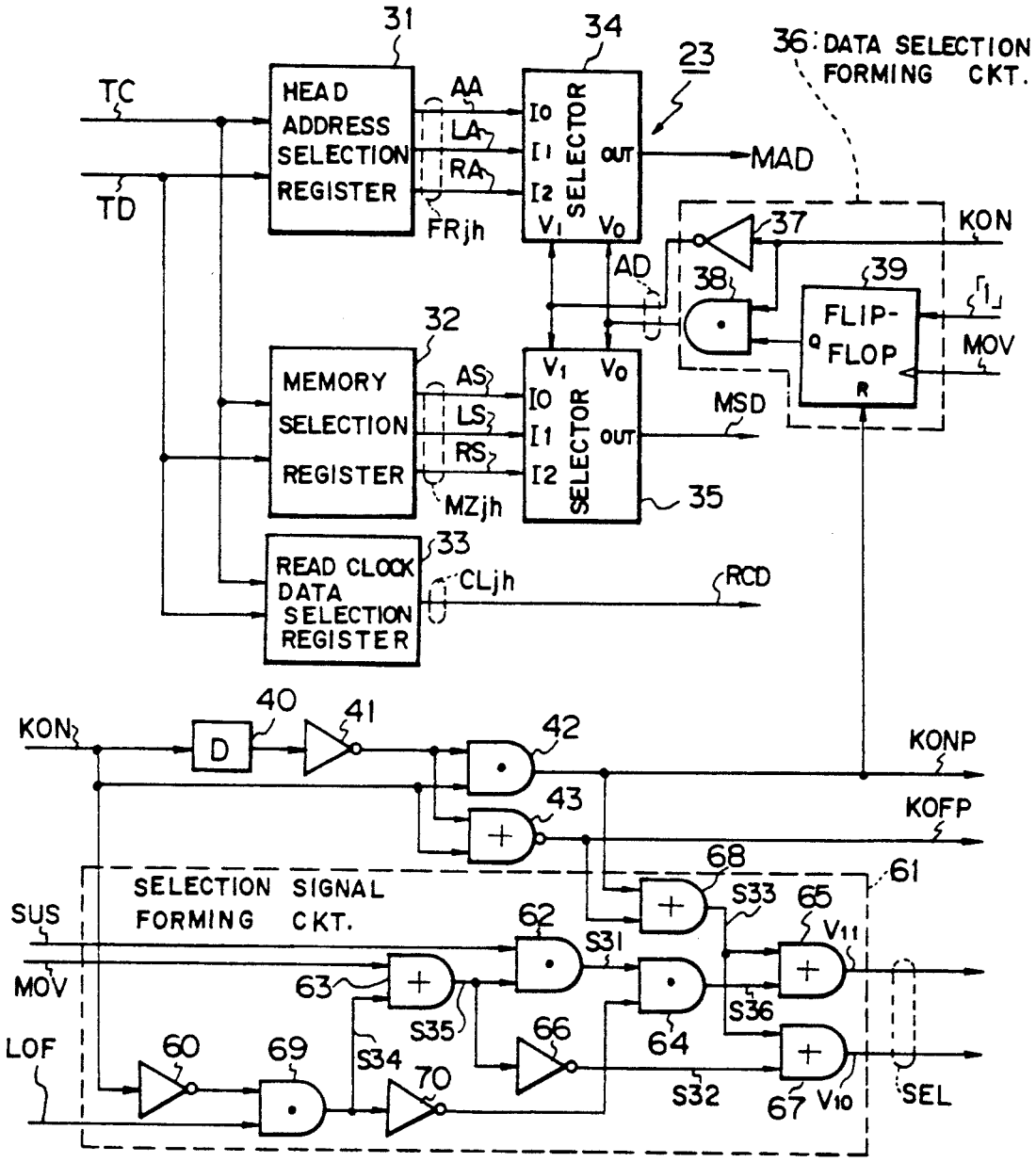
FIG. 4 is a block diagram showing a specific example of an address designation circuit 23 in FIG. 3.

The address designation circuit 23 includes, as shown in FIG. 4, a head address selection register 31, a memory size selection register 32 and a read clock data selection register 33 which respectively perform a selection operation in response to the tone color selection signal TC and the touch data TD.

Figure 7:
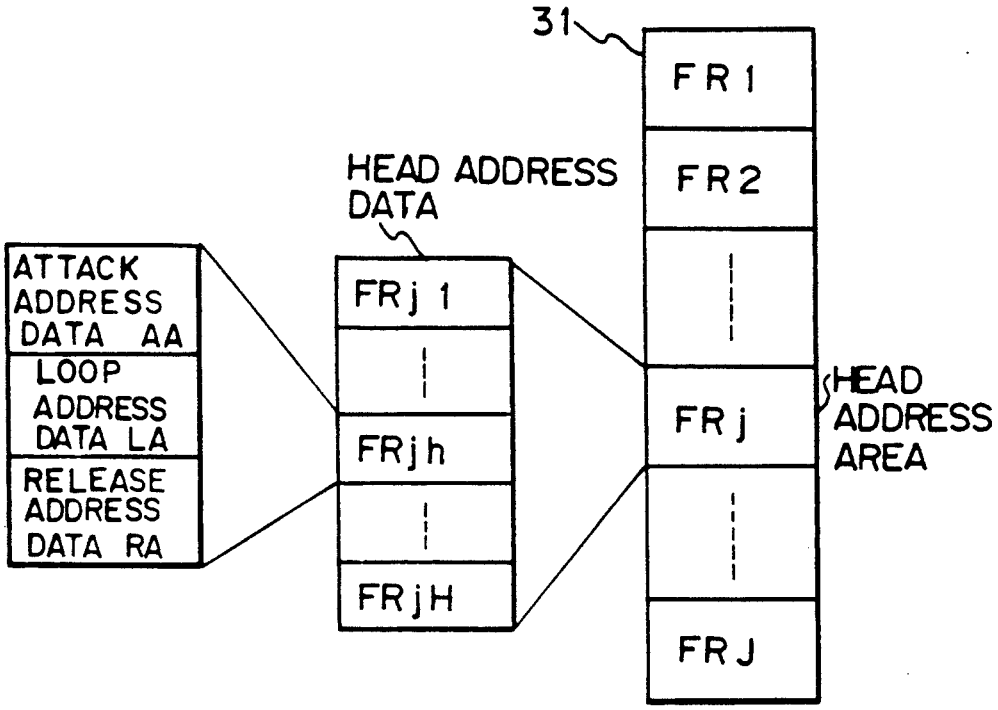
FIGS. 7, 8 and 9 are schematic diagrams showing specific examples of a head address selection register 31, a memory size selection register 32 and a readout clock data selection register 33.

The head address selection register 31 has, as shown in FIG. 7, head address memory areas FRj (j=1, 2, . . . J) of the same number as the tone colors which can be selected by the tone color selection signal TC and, when the tone color selection signal TC has designated a j-th tone color, the head address data stored in the j-th head address memory area FRj is read out.

Each head address memory area FRj stores head address data FRjh (h=1, 2, . . . H) corresponding to the kinds of touch data which can be selectively designated by the touch data TD. Each head address data FRjh consists of attack address data AA, loop address data LA and release address data RA respectively for one shape.

Therefore, the head address selection register 31 stores head address data FRjh (j=1 to J, h=1 to H) of J×H for the tone color selection signal TC and the touch data TD and can designate head addresses AAko, LAko and RAko of attack envelope data DAAk, loop envelope data DLAk and release envelope data DRAk stored in envelope shape data memory areas ENVk (k=1 to K) of the envelope shape memory 21 (FIG. 5) by attack address data AA, loop address data LA and release address data RA constituting the J×H head address data.

Figure 5:
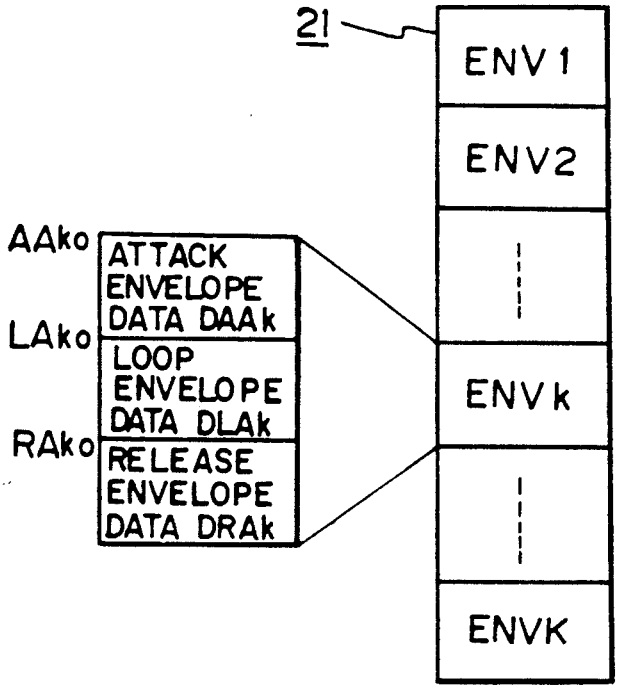
FIG. 5 is a schematic diagram showing a specific example of an envelope shape memory 21 in FIG. 3.

In this embodiment, the envelope shape memory 21 stores, as shown in FIG. 5, attack envelope data DAAk, loop envelope data DLAk and release envelope data DRAk sequentially in K envelope shape data memory areas ENVk (k=1, 2, . . . K). By supplying the head address data MAD designating the head address AAko, LAko and RAko of the attack envelope data DAAk, loop envelope data DLAk and release envelope data DRAk and then incrementing the address signal S6 by one address in response to the address stepping data ADD, respective envelope shape values of the attack envelope data DAAk, loop envelope data DLAk and release envelope data DRAk can be read out.

The attack envelope data DAAk having been read out in this manner represents the sampling shape value of the attack shape W1 for one shape as described above with reference to FIG. 2. The loop envelope data DLAk represents the sampling shape value of the loop shape W2 for one shape and the release envelope data DRAk represents the sampling shape value of the release shape W3 for one shape.

Figure 6:
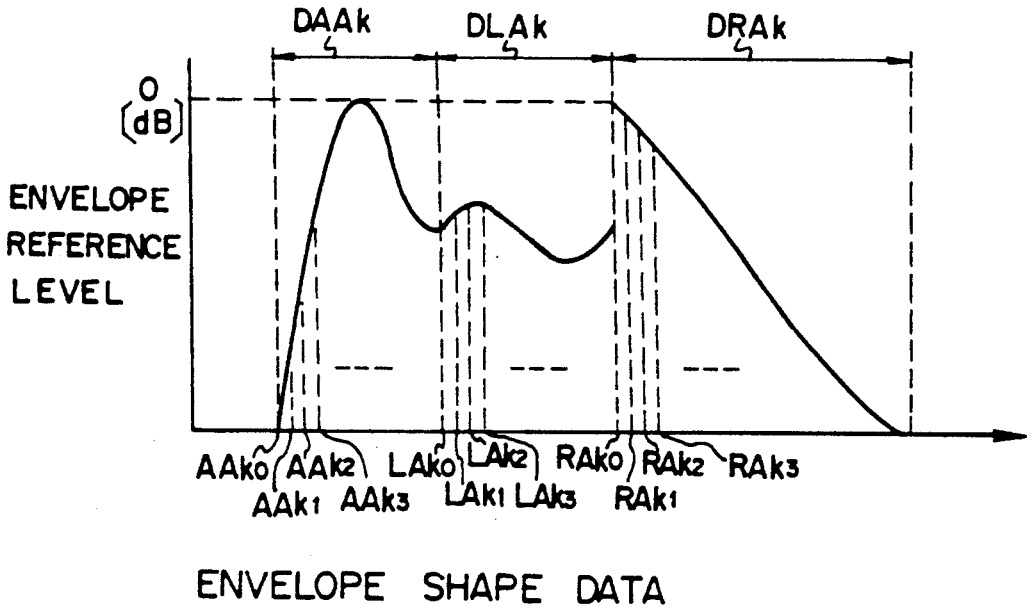
FIG. 6 is a waveform diagram showing envelope shape data to be stored in the envelope shape memory 21 in FIG. 3.

In the attack envelope data DAAk, as shown in FIG. 6, the maximum level of the envelope shape is set at reference amount of attenuation, i.e., 0 dB and each sampling value is expressed in logarithm on the basis of this reference level 0 dB and stored sequentially at stepping addresses AAk1, AAk2, . . . .

As to the loop envelope data DLAk also, sampling shape values of the loop shape W2 expressed in logarithm on the basis of reference level 0 dB are stored from the head address LAko sequentially at stepping addresses LAk1, LAk2 . . . .

The release envelope data DRAk consists of sampling shape values of the release shape W3 from the reference level 0 dB to a predetermined shape value level (in this case, a range of shape values which is nearly equivalent to the maximum shape value of the attack shape value W1) based on the reference level 0 dB and expressed in logarithm and each sampling data is stored from the head address RAko sequentially at stepping addresses RAk1, RAk2, . . . .

Figure 8:
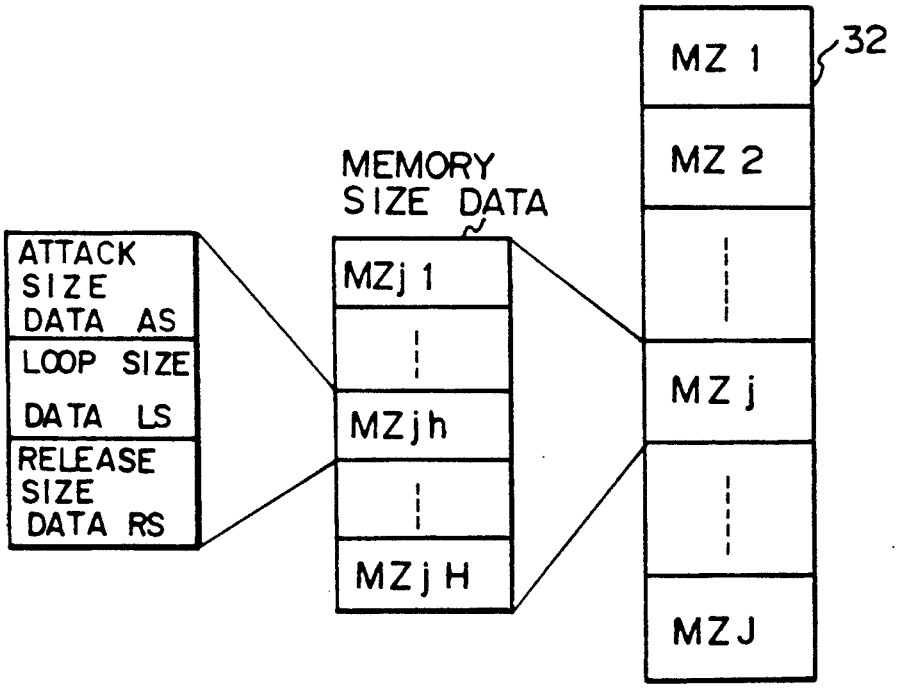

The memory size selection register 32 has, as shown in FIG. 8, memory size memory areas MZj (j=1, 2 . . . J) which can be selected by the tone color selection signal TC as in the head address selection register 31 and stores, in each memory size area AZj, memory size data MZjh (h=1, 2 . . . H).

Each memory size data MZjh consists of attack size data AS, loop size data LS and release size data RS representing an address range to be read out as envelope shape data which is to be currently used among shape value data constituting the attack shape W1, loop shape W2 and release shape W3.

Therefore, when, by selectively designating the head address data FRjh in the head address selection register 31 as FRjh (j=1 to J) and FRjh (h=1 to H) in response to the tone color selection signal TC and the touch data TD, a corresponding envelope shape data memory area ENVk of the envelope shape memory 21 has been selectively designated and the head address AAko, LAko and RAko of its attack envelope data DAAk, loop envelope data DLAk and release envelope data DRAk have been selectively designated, attack size data AS, loop size data LS and release size data RS which have been preassigned to the attack envelope data DAAk, loop envelope data DLAk and release envelope data DRAk can be provided from the memory size selection register 32.

Figures 9, 10:
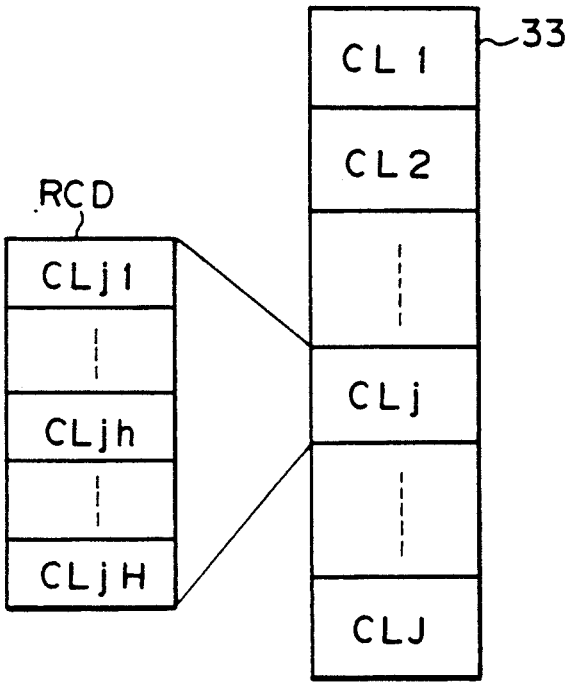
FIG. 10 is a truth table showing operations of selectors 34 and 35 in FIG. 4.

The read clock data selection register 33 has, as shown in FIG. 9, read clock data memory areas CLj (j=1, 2 . . . J) which is selectively designated by the tone color selection signal TC as in the head address selection register 31 (FIG. 7) and each read clock data memory area CLj stores read clock data CLjh (h=1, 2 . . . H) which can be selectively designated by the touch data TD.

Therefore, when the tone color selection signal TC and touch data TD have been supplied to the address designation circuit 23 (FIG. 4), the attack address data AA, loop address data LA and release address data RA constituting the head address data FRjh are supplied from the head address selection register 31 to the selector 34 in accordance with a combination of the tone color selection signal TC and the touch data TD, and the attack size data AS, loop size data LS and release size data RS constituting the selectively designated memory size data MZjh are supplied from the memory size selection register 32 to the selector 35 and, further, selectively designated read clock data CLjh is provided as read clock data RCD from the read clock data selection register 33.

The selectors 34 and 35 are selectively controlled by a data selection signal AD formed by a data selection signal forming circuit 36. The data selection signal AD is 2-bit data V0 and V1 and the selectors 34 and 35 perform selection operations as shown in FIG. 10 in accordance with change in the data selection signal AD.

More specifically, when bit data V1 and V0 of the data selection signal AD are "0" and "1", the selection mode in the selectors 34 and 35 is an attack mode and the selectors 34 and 35 deliver out, from their output terminals OUT, the attack address data AA and attack size data AS received at their input terminal I0 from the head address selection register 31 and the memory size selection register 32 as memory address data MAD and memory size data MSD.

When the bit data V1 and V0 of the data selection signal AD are "0" and "1", the selection mode of the selectors 34 and 35 is a loop mode and the loop address data LA and loop size data LS received at input terminals I1 from the head address selection register 31 and the memory size selection register 32 are selected and delivered out, from the output terminals OUT, as the memory address data MAD and the memory size data MSD.

When the bit data V1 and V0 of the data selection signal AD have become "1" and "0", the selection mode of the selectors 34 and 35 is turned to a release mode and the release address data RA and the release size data RS received at input terminals I2 from the head address selection register 31 and the memory size selection register 32 are selected and delivered out, from the output terminals OUT, as the memory address data MAD and memory size data MSD.

The data selection signal forming circuit 36 forms a data selection signal AD of a selection mode corresponding to an envelope shape portion which is being currently generated. That is, the data selection signal forming circuit 36 inverts the key-on signal KON by an inverter 37 and provides the inverted signal as the bit output V1 of the data selection signal AD and also supplies the key-on signal KON to an AND gate 38 and provides the output of the AND gate 38 as the bit output V0 of the data selection signal AD.

To the AND gate 38 is applied a Q output of a flip-flop circuit 39 which is reset by a key-on pulse KONP which rises, as shown in FIG. 2(B), at a timing when the key-on signal KON rises.

The flip-flop circuit 39 receives a signal "1" as its D input and a memory size excess detection signal MOV supplied from the address counter 24 (FIG. 3) at its clock input.

In the data selection signal forming circuit 36 of this construction, when the key-on signal KON has risen to "1" level (FIG. 2 (D)) by depression of a key in the keyboard 2 at a timing of the time point t1 of FIG. 2, this signal maintains the bit data V1 at "0" level through an inverter 37. At this time, the flip-flop circuit 39 is reset by the key-on pulse KONP and its Q output falls to "0" level so that the bit output V0 becomes "0".

Accordingly, the bit outputs V1 and V0 of the data selection signal AD become "0" and holds "0" during the key-on so that the attack mode of FIG. 10 is selected and the address counter 24 is set at a mode in which the attack shape W1 is read out. In this attack mode, when the memory size excess detection signal MOV has risen to "1" level at a timing of time point t2 in FIG. 2, the flip-flop circuit 39 is set by the "1" input applied at its D input and thereby drops its Q output to "0" level. At this time, the output of the AND gate 38 rises to "1" level and, as a result, the bit outputs V1 and V0 of the data selection signal AD become "0" and "1". Thus, the address counter 24 is set in a mode in which the loop shape W2 is read out.

In the loop selection mode, when the key-off operation is made on the keyboard 2 at a timing of time point t7 in FIG. 2, the key-on signal KON falls from "1" level to "0" level (FIG. 2 (D)). The bit data V1 and V0 of the data selection signal AD therefore become "1" and "0" and, as a result, the selectors 34 and 35 are switched to a release selection mode as shown in FIG. 10 so that the address counter 24 is set at a mode in which the release shape W3 is read out.

In this embodiment, the address designation circuit 23 (FIG. 4) supplies the key-on signal KON as a first input signal to a 2-input AND gate 42 through a delay circuit 40 and an inverter 41 and also supplies the key-on signal KON directly to the AND gate 42 as a second input, thereby producing a key-on pulse KONP (FIG. 2 (B)) which rises to "1" level at a timing when the key-on signal KON has risen to "1".

In addition, the address designation circuit 23 supplies the output of the inverter 41 to a 2-input NOR gate 43 as its first input signal and also supplies the key-on signal KON directly to the NOR gate 43 as its second input signal thereby generating a key-off pulse KOFP (FIG. 2 (C)) which rises to "1" level at a timing when the key-on signal KON has fallen to "0" level.

Figure 11:
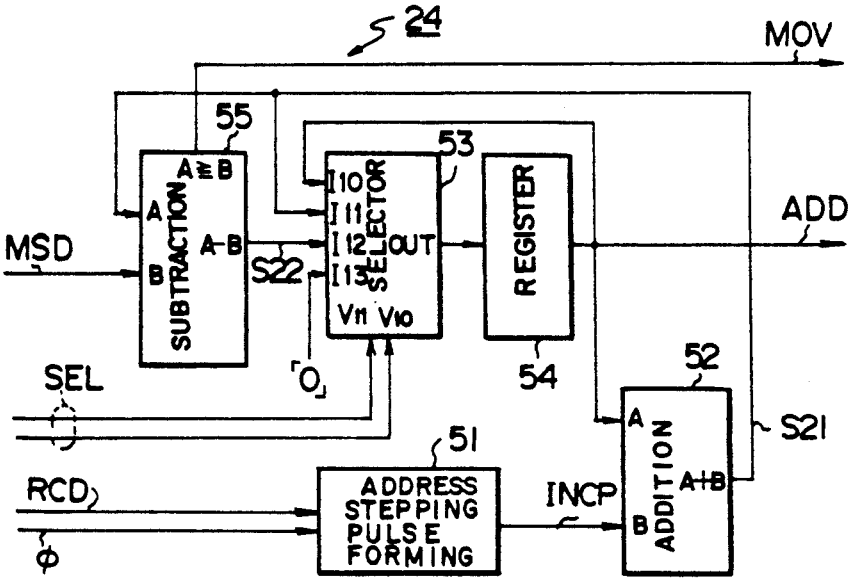
FIG. 11 is a block diagram showing a specific example of an address counter 24 in FIG. 3.

The address counter 24 includes, as shown in FIG. 11, an address stepping pulse forming circuit 51 made of a counter which counts a stepping clock pulse $\phi$ by the counter and supplies its overflow pulse as an address stepping pulse INCP to an addition circuit 52.

The overflow count number of the address stepping pulse forming circuit 51 is determined by the read clock data RCD provided by the address designation circuit 23 (FIG. 4) and, therefore, the pulse period of the address stepping pulse INCP is controlled to correspond to the read clock data RCD.

Addition output S21 of the addition circuit 52 is loaded in a register 54 through a stepping mode input terminal I11 of a selector 53.

The register 54 stores current stepping address data. Its memory output is supplied as the stepping address data ADD and this data ADD is fed back to the register 54 through a hold mode input terminal I10 of the selector 53 so that the stepping address data ADD of the register 54 is dynamically held through this feedback loop during the hold mode.

In addition, the stepping address data ADD of the register 54 is applied to A input terminal of the addition circuit 52 and, as a result, an addition output S21 of the addition circuit 52 which steps by one address by adding the address stepping pulse INCP to the current stepping address data ADD is obtained and this addition output S21 is loaded in the register 54 through a stepping mode input I11 of the selector 53.

The addition output S21 of the addition circuit 52 is applied to an addition input terminal A of a subtraction circuit 55 to subtract the memory size data MSD supplied from the address designation circuit 23 (FIG. 4) to a subtraction input terminal B of the subtraction circuit 55. A subtraction output S22 of the subtraction circuit 55 is loaded in the register 54 through a return mode input terminal I12 of the selector 53.

In this manner, the subtraction circuit 55 compares the addition output S21 of the addition circuit 52 with the memory size designated by the address designation circuit 23 (FIG. 4) and loads a difference between the two data in the register 54 and also supplies, when the addition output S21 has exceeded the memory size data MSD, a detection output A≧B as a memory size excess detection signal MOV to the address designation circuit 23 (FIG. 4) thereby to inform that it is a timing at which the operation mode is to be changed.

The address designation circuit 23 supplies the memory size excess detection signal MOV to the flip-flop circuit 39 of the data selection forming circuit 36 to cause it to perform an inverting operation and also to a selection signal forming circuit 61 to cause it to generate 2-bit data V11 and V10 and supplies the selection signal SEL to the selector 53.

The selection signal forming circuit 61 (FIG. 4) receives the sustain select signal SUS directly to a 2-input AND gate 62 and also receives the memory size excess detection signal MOV through an OR gate 63 and thereby supplies the AND output S31 which is "0" level of an AND gate 62 as the bit output V11 of the selection signal SEL through an AND gate 64 and an output OR gate 65 during the sustain shape selection mode in which the loop shape W2 described above with respect to FIG. 2 (A) and when the memory size excess detection signal MOV is "0" (i.e., when envelope shape data of the attack shape W1, loop shape W2 and release shape W3 is being read out).

Simultaneously, the memory size excess detection signal MOV obtained through an OR gate 63 is inverted by an inverter 66 and the inverted output S32 of "1" level is supplied as the bit output V10 of the selection signal SEL through an output OR gate 67.

By turning of the bit outputs V11 and V10 of the selection signal SEL to "0" and "1", the selection mode of the selector 53 (FIG. 11) is switched to the stepping selection mode. At this time, the selector 53 loads data of a stepping mode input terminal I11, and therefore the addition output S21 of the addition circuit 52, in the register 54 and contents of the register 54 thereby can be replaced sequentially by stepped data.

In this operation mode, the addition circuit 52 adds the address stepping pulse INCP to the contents of storage in the register 54 whenever the pulse INCP has arrived thereby to load it as the addition output S21 in the register 54 through the selector 53. As a result, the stepping operation mode in which the stepping address data ADD consisting of contents of storage of the register 54 steps by one address in response to the address stepping pulse INCP is obtained.

When the addition output S21 of the addition circuit 52 has exceeded the memory size data MSD and the memory size excess detection signal MOV has thereby risen to "1" level, the AND output S31 of the AND gate 62 rises to "1" level and the bit output V11 of the selection signal SEL rises to "1" level while an inverter output S32 of an inverter 66 falls to "0" level which signal is provided as the bit output V10 of the selection signal SEL through an AND gate 64 and an output OR gate 67.

Figures 12, 13, 15:
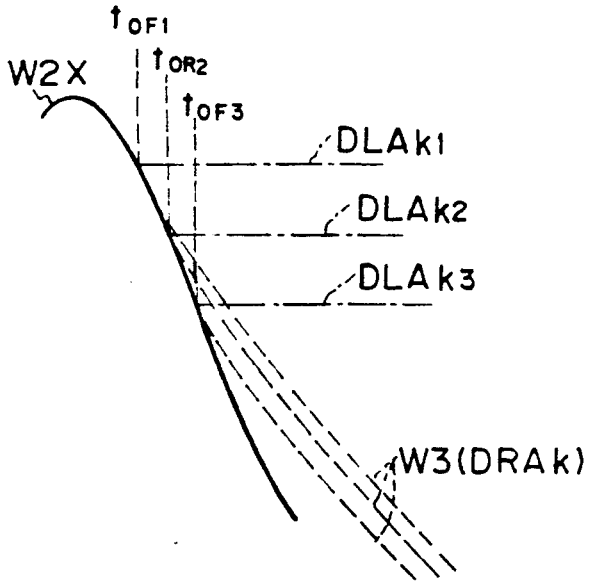
FIG. 12 is a truth table showing the operation of a selector 53 in FIG. 11.
FIG. 13 is truth table showing the operation of a selector 73 in FIG. 3.
FIG. 15 is a waveform diagram for describing the effect of connecting a release shape.

Thus, the bit outputs V11 and V10 of the selection signal SEL are switched to "1" and "0" respectively. At this time, the selection mode of the selector 53 (FIG. 11) is switched to a return mode as shown in FIG. 12 in which the subtraction output S22 supplied at the input terminal I12 from the subtraction circuit 55 is loaded in the register 54 whereby address data representing difference between the current stepping address data ADD and the memory size data MSD is held by the register 54.

At this time, the addition circuit 52 receives, at one of its addition inputs, the output of the register 54, i.e., stepping address data ADD and a new stepping operation thereby is started on the basis of this address representing the difference.

Thus, as has been described with reference to FIG. 2(A), after the attack shape W1 has finished at the time point t2, each time the loop shape W2 has finished at the time points t3, t4, t5 and t6, the stepping address data ADD of the register 54 is caused to return to the value of the subtraction output S22 when the addition output S21 representing the current stepping address data ADD has exceeded the memory size data MSD and thereafter the loop shape W2 is repeatedly read out.

In addition, the selection signal forming circuit 61 receives the key-on pulse KONP and the key-off pulse KOFP at output OR gates 65 and 67 through an OR gate 68 and thereby provides an output of "1" level as the bit outputs V11 and V10 of the selection signal SEL when the key-on pulse KONP (FIG. 2(B)) and the key-off pulse KOFP (FIG. 2(C)) have been supplied.

At this time, the selection mode of the selector 53 (FIG. 11) becomes the reset mode as shown in FIG. 12 in which all "0" data which have been applied to a reset input I13 is loaded in the register 54 through the selector 53. As a result, the stepping address data provided from the register 54 is controlled to a reset state of all "0".

Resetting of the stepping address data ADD to all "0" by the key-on pulse signal KONP or the key-off pulse signal KOFP means that the stepping address data ADD (FIG. 3) has been set at a state in which the stepping address data ADD can access the head address AAko or RAko of the attack envelope data DAAk or release envelope data DRAk of the envelope shape memory 21 (FIG. 7) whereby the attack shape W1 or release shape W3 can subsequently be read out.

Further, in the selection signal forming circuit 61 (FIG. 4), a level off detection signal LOF is supplied to an AND gate 69 and a signal obtained by inverting the key-on signal KON by an inverter 60 is supplied to the OR gate 69. An AND output S34 of the AND gate 69 is supplied to the OR gate 63 and a signal obtained by inverting the output S34 by an inverter 70 is supplied to an AND gate 64.

As has been described with reference to FIG. 2(A), when the release shape data has crossed a time point t78 at the amplitude "0" level ($-\infty$dB) while the release shape W3 is being read from the envelope shape memory 21, an off level detection circuit 71 detects this crossing and generates a level off detection signal LOF (FIG. 2 (E)) which rises to "1" level.

Thus, by rising of the level off detection signal LOF to "1" level at the time point t78 after falling of the key-on signal KON (FIG. 2(D)) at the time point t7 of FIG. 2, the AND output S34 of "1" level is generated from the AND gate 69 and supplied to the OR gate 63. Then, the output S35 of the OR gate 63 which is "1" level is converted to an inverted output S32 of "0" level by an inverter 66 and is supplied as the bit output V10 from the output OR gate 67.

Simultaneously, the AND output S34 of "1" level is inverted by an inverter 70 and supplied to the AND gate 64 and the AND output S36 which has fallen to "0" level is supplied as the bit output V11 through the output OR gate 65.

As a result, the selection mode of the selector 53 is set to the hold mode (FIG. 12) by falling of the bit outputs V11 and V10 of the selection signal SEL to "0" and the stepping address data ADD having the same address as one at the time point t78 is continuously supplied to the addition circuit 25 (FIG. 3) by holding the data stored in the register 54 through the selector 53. The envelope shape memory 21 therefore produces continuously envelope shape data in the release shape data (FIG. 6) which is read out by the stepping address when the value of the envelope shape signal S7 has fallen to "0" level.

In the above described manner, the address designation circuit 23 (FIG. 4) produces the memory address data MAD in response to the tone color selection signal TC and touch data TD, the address counter 24 (FIG. 11) produces the address stepping data ADD and, as shown in FIG. 3, the addition circuit 25 adds these data together and supplies the result of the addition as the address signal S6 to the envelope shape memory 21 (FIG. 5). The attack envelope data DAAk, loop envelope data DLAk and release envelope data DRAk in the envelope shape data memory area ENVk (k=1 to K) of the envelope shape memory 21 (FIG. 5) are thereby read out and supplied as the envelope shape read out signal S7 to one addition input of the addition circuit 72 and also to an input terminal I21 of the selector 73.

The selector 73 causes shape value data for connecting a loop shape W2X which is a portion of one loop shape W2 smoothly to the release shape W3 to be loaded in a register 74 which is provided for storing connection information when the key-off pulse KOFP (FIG. 2(C)) has been produced and provides this data as a connection signal S8. The selector 73 operates as shown in FIG. 13 in response to the selection control signal CON whose bit data consists of the key-on pulse KONP (FIG. 2 (B)) and the key-off pulse KOFP (FIG. 2(C)).

More specifically, when the key-on pulse signal KONP has risen to "1" level (at this time, the key-off pulse signal KOFP is at "0" level), the selector 73 is turned to the reset mode and receives all "0" data from the reset input terminal I22. At this time, the register 74 is reset to a state in which the register 74 has no significant connection information.

At a timing when the key-off pulse signal KOFP rises to "1" level, the key-on pulse signal KONP has fallen to "0" level so that the selector 73 is set to the load mode as shown in FIG. 13 and causes the envelope shape readout signal S7 provided by the envelope shape memory 21 to a load input terminal I21 to be loaded in the register 74. At the timing when the key-off pulse signal KOFP rises to "1" level (time point t7 in FIG. 2), the envelope shape readout signal S7 is reading out a part of one cycle of the loop shape W2 so that the shape value data at this time point t7 is provided as the envelope shape readout signal S7. Accordingly, this shape value data is loaded in the register 74 and delivered therefrom.

On the other hand, at a timing when neither the key-on pulse signal KONP or key-off pulse signal KOFP is generated, the both bit data of the control signal CON are at "0" level so that the selector 73 is set to the hold mode as shown in FIG. 13 to load data at a hold input terminal I20 in the register 74. Accordingly, a connection signal S18 provided at the output terminal of the register 74 is stored dynamically through the selector 73 and this signal S18 is added to the envelope shape readout signal S7 by the addition circuit 72.

The addition circuit 72 adds the envelope shape readout signal S7 and the connection signal S8 together and supplies its addition output S9 as the envelope shape signal S5 to the logarithm/linear conversion circuit 12 (FIG. 1) through an interpolation circuit 75.

(3) Envelope shape forming operation

In the above described construction, when a player has depressed a key in the keyboard 2 under the condition that the tone color selection signal TC has been generated by a selective operation by the player of the tone color selection operator 10A of the tone color selection circuit 10 of FIG. 1, the key code data KCD and the key-on signal KON for the depressed key are generated by the key depression detection circuit 3 and the touch data TD corresponding to the touch operation on the depressed key is generated by the touch detection circuit 6.

The tone signal generation circuit 4 thereupon generates the tone signal waveform signal S1 by controlling a tone signal of a tone having a tone color corresponding to the tone color selection signal TC and a tone pitch corresponding to the key code of the depressed key in accordance with the touch data TD and supplies this tone waveform signal S1 to the multiplication circuit 7.

In this state, in the envelope shape generation circuit 5, upon rising of the key-on pulse signal KONP to "1" level at the timing when the key-on signal KON has risen to "1" level, i.e., at the time point t11 in FIG. 14(C), the selectors 34 and 35 in the address designation circuit 23 (FIGS. 3 and 4) are set to the attack mode.

As a result, the attack address data AA among the head address data FRjh stored in the head address selection register 31 (FIG. 7) is supplied as the memory address data MAD to the addition circuit 25 (FIG. 3) in response to the tone color selection signal TC and the touch data TD.

Simultaneously, the attack size data among the memory size data MZjh prestored in the memory size selection register 32 (FIG. 8) is supplied as the memory size data MSD to the address counter (FIG. 3) in response to the tone color selection signal TC and the touch data TD.

Further, the read clock data CLjh (FIG. 9) prestored in the read clock data selection register 33 is supplied as the read clock data RCD to the address counter 24 (FIG. 3) in response to the tone color selection signal TC and the touch data TD.

At this time, in the address counter 24 (FIG. 11), the addition output S21 which steps at a stepping speed corresponding to the read clock data RCD is generated by the addition circuit 52 by generating the address stepping pulse INCP having a period corresponding to the read clock data RCD in the address stepping pulse forming circuit 51 and supplying it to the addition circuit 52.

At this time, the selection circuit 61 of the address designation circuit 23 (FIG. 4) produces the selection signal SEL which causes the reset selection mode to be selected on the condition that the key-on pulse signal KONP has risen to "1" level as shown in FIG. 12 and the selector 53 of the address counter 24 performs the operation that all "0" data is written in the register 54 from the preset input terminal I13.

The addition circuit 52 therefore supplies the contents of counting of the register 54 having the data of all "0" to the addition circuit 25 (FIG. 3) and thereby designates the address consisting of the result of addition of the memory address data MAD and the address stepping data ADD supplied by the address designation circuit 23 as the address signal S6 to the envelope shape memory 21.

As a result, in the envelope shape memory 21 (FIG. 5), the head address AAko of the attack envelope data DAAk which has been designated by the head address data FRjh read from the head address selection register 31 (FIG. 7) is accessed by the address signal S6 and the attack envelope data DAAk stored at the head address AAko is supplied as the envelope shape readout signal S7 (FIG. 3) to the addition circuit 72 and the selector 73.

At this time, the selector 73 is controlled to the reset selection mode because KONP="1" and KOFP="0" are provided as the bit data of the control signal CON (FIG. 13) and all "0" data is thereby written in the register 74 as the connection data.

As a result, the addition circuit 72 provides the envelope shape readout signal S7 produced by the envelope shape memory 21 as the addition output S9 so that the corresponding envelope shape signal S5 is supplied as the envelope coefficient signal S2 to the multiplication circuit 7 through the logarithm/linear conversion circuit 12 (FIG. 1).

When the key-on pulse signal KONP (FIG. 14(C)) has risen to "0" level in this state, the bit outputs of the selection signal SEL become V11="0" and V10="1" in the selection signal forming circuit 61 (FIG. 4) so that the selection mode of the selector 53 becomes the stepping mode and the addition output S21 of the addition circuit 52 thereby is written in the register 54 from the stepping input terminal I11. The addition circuit 52 therefore is controlled in such a manner that each time the address stepping pulse INCP is generated, the stepping address data ADD of the register 54 is added by one address and held in the register 54 through the selector 53.

An operation state therefore is brought about in which the stepping address data ADD accesses the addresses of the attack envelope data DAAk of the envelope shape memory 21 (FIG. 5) from the head address AAko by incrementing by one address in response to the address stepping pulse INCP.

When the key-on pulse signal KONP (FIG. 14(C)) has risen to "0" level, the bit data of the control signal CON of the selector 73 (FIG. 3) become KONP="0" and KOFP="0" so that the selection mode of the selector 73 becomes the hold mode as shown in FIG. 13 and the data stored in the register 29 (i.e., the data of all "0") is fed back to the register 74 through the hold input terminal I20 and held in the register 74.

In this manner, the addition circuit 72 maintains the condition under which it receives the data of all "0" as the connection signal S8 and, accordingly, supplies, as the addition output S9, i.e., the envelope shape signal S5, the attack envelope data DAAk read from the envelope shape memory 21 as the envelope shape readout signal S7.

Therefore, as the tone signal data S3 of the multiplication circuit 7 (FIG. 1), there is provided the tone signal data S3 obtained by multiplying the tone waveform signal S1 produced by the tone waveform generation circuit 4 with the envelope coefficient signal S2 corresponding to the attack envelope data DAAk which is sequentially read from the envelope shape memory 21 (FIG. 5). By supplying this tone signal data S3 to the sound system 9 as the tone signal data S4, a tone imparted with the attack shape W1 (FIG. 2(A)) is generated by the sound system 9.

In this mode in which the attack shape W1 is formed, the attack size data AS among the memory size data MZjh in the memory size selection register (FIG. 8) is supplied to the subtraction circuit 55 of the address counter 24 (FIG. 11). The subtraction circuit 55 performs the operation for detecting whether or not the address data which is stepped in the register 54 has exceeded the memory size data MSD and provides a signal of "0" level as the memory size excess detection signal MOV obtained from the subtraction circuit 55 unless the addition output S21 representing the current stepping address data.

As a result, the selection signal forming circuit 61 (FIG. 4) continues to output the bit data V11="0" and V10="1" as the selection signal SEL (FIG. 12) to the selector 53 so that the stepping mode is maintained.

Simultaneously, since the flip-flop circuit 39 of the address designation circuit 23 (FIG. 4) does not perform the inverting operation, the reset mode is maintained and, accordingly, the address designation circuit 23 maintains the condition under which the head address AAko of the attack envelope data DAAk is supplied as the memory address data MAD.

Figure 14:
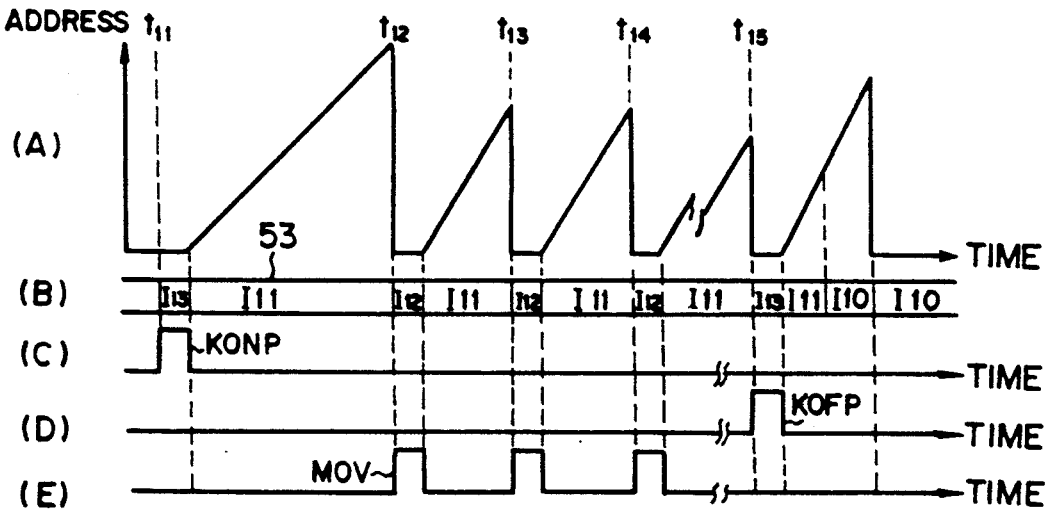
FIG. 14 is a waveform diagram for describing the address stepping operation of the envelope shape generation circuit 5 in FIG. 1.

Then, when the addition output S21 of the addition circuit 52 in the address counter 24 (FIG. 11) has exceeded the memory size data MSD at the time point t12 in FIG. 14, the memory size excess detection signal MOV rises to "1" level (FIG. 14(E)).

At this time, the bit outputs of the selection signal SEL provided by the selection signal forming circuit 61 (FIG. 4) change to V11="1" and V10="0" and the selection mode of the selector 53 (FIG. 11) is thereby switched to the return mode.

The selector 53 thereupon loads the subtraction output S22 provided by the subtraction circuit 55 (at this time, the subtraction output S22 represents the amount of excess when the addition output S21 has exceeded the memory size data MSD) in the register 54 through the return input terminal 112 and thereby brings the stepping address data ADD back to the difference data and supplies the difference data to addition circuit 52.

Simultaneously, the flip-flop circuit 39 of the address designation circuit 23 (FIG. 4) performs the set operation by rising of the memory size excess detection signal MOV to level "1" (FIG. 14 (E)) so that the bit data of the data selection signal AD are switched to V1="0" and Vo="1". The selection mode of the selectors 34 and 35 is thereby controlled to the loop mode as shown in FIG. 10 so that the address designation circuit 23 is switched to the state in which the loop address data LA among the head address data FRjh (FIG. 7) stored in the head address selection register 31 is provided as the memory address data MAD. The selector 35 is switched to the state in which the loop size data LS among the memory size data MZjh (FIG. 8) stored in the memory size selection register 32 is provided as the memory size data MSD.

Further, the state in which the read clock data CLjh (FIG. 9) stored in the read clock data selection register 33 is provided directly as the read clock data RCD is maintained.

Accordingly, as the address signal S6 supplied to the envelope shape memory 21 through the addition circuit 25 (FIG. 3), the memory address data MAD designating the head address LAko of the loop envelope data DLAk (FIG. 5) of the envelope shape memory 21 is supplied.

Simultaneously, as the address signal S6, the address stepping data ADD corresponding to the difference data written in the register 54 of the address counter 24 (FIG. 11) is supplied and, accordingly, the envelope shape memory 21 provides the loop envelope data DLAk stored at addresses stepping sequentially from the address which has stepped by the amount of the difference address data from the head address LAko among the loop envelope data DLAk and supplies this data as the envelope shape readout signal S7 to the addition circuit 72 and the selector 73.

Then, when the addition output S21 of the addition circuit 52 has decreased by writing of the difference data in the register 54 and the memory size excess detection signal MOV has returned to "0" level, the bit data of the selection signal SEL provided by the selection signal forming circuit 61 (FIG. 4) return to V11="0" and V10="1" and the selection mode of the selector 53 thereby is switched to the stepping mode again as shown in FIG. 12. Accordingly, the operation mode returns to one in which the addition output S21 which is stepped by the address stepping pulse INCP is written in the register 54 through the selector 53 so that the loop envelope data DLAk is read out as the address signal S6 of the envelope shape memory 21 (FIG. 3) and the envelope shape readout signal S7 consisting of the loop envelope data DLAk is provided as the addition output S9, i.e., the envelope shape signal S5 through the addition circuit 72.

Consequently, the multiplication circuit 7 (FIG. 1) forms the tone signal data S3 which is the tone waveform signal S1 imparted with the envelope by the envelope coefficient signal S2 corresponding to the loop envelope data DLAk stored in the envelope shape memory 21 and the tone imparted with the loop shape W2 (FIG. 2(A)) as the envelope shape is propagated from the sound system 9.

When, in this state, the addition output S21 provided in response to the stepping address data ADD supplied from the register 54 has exceeded the memory size data MSD consisting of the loop size data LS and the memory size excess detection signal MOV has risen to level "1" at the time point t13 of FIG. 14 (E), the bit outputs of the selection signal SEL supplied from the selection signal forming circuit 61 (FIG. 4) are switched to V11="1" and V10="0" accordingly and the selection mode of the selector 53 (FIG. 11) of the address counter 24 thereby is switched to the return mode as shown in FIG. 13 in which the subtraction output S22 of the subtraction circuit 55 is written in the register 54.

At this time, the subtraction output S22 represents difference data between the contents of the addition output S21, i.e., the stepping address data ADD and the loop size data LS and the address value stored in the register 54 is reduced by using this difference data as the new stepping address data ADD.

However, when the memory size excess detection data MOV has risen to "1" level at the time point t13, the flip-flop circuit 39 of the address designation circuit 23 (FIG. 4) does not perform the inverting operation since it has already performed the inverting operation at the time point t12 and, accordingly, the address designation circuit 23 maintains the state in which it provides the loop address data LA of the head address selection register 31 (FIG. 7) as the memory address data MAD, provides the loop size data LS of the memory size selection register 32 (FIG. 8) as the memory size data MSD and, further, provides the read clock data CLjh of the read clock data selection register 33 (FIG. 9) as the read clock data RCD.

Accordingly, as the address signal S6 of the envelope shape memory 21 (FIG. 3), there is provided the address data obtained by adding the stepping address data ADD which has decreased to the difference data written in the register 54 (FIG. 11) as the subtraction output S22 to the memory address data MAD which has the same contents as the memory address data MAD read out at the time point t12 in FIG. 14. Therefore, the loop envelope data DLAk is read out again from the envelope shape memory 21 on the basis of the head address LAko designated by the memory address data MAD and the read out loop envelope data DLAk is supplied as the envelope shape readout signal S7 (FIG. 3) to the addition circuit 72.

As a result, the envelope shape generation circuit 5 (FIG. 1) executes the operation of reading out the second loop shape W2 during the period of time from the time point t13 to time point t14.

Subsequently, in the same manner as described above, each time the memory size excess detection signal MOV has risen to level "1" in the subtraction circuit 55, the address counter 24 (FIG. 11) repeats the operation for bringing the contents of storage in the register 54 back to difference data between the current stepping address data ADD and the memory size data MSD. The envelope shape generation circuit 5 thereby reads out the loop envelope data DLAk repeatedly so that it generates the envelope shape (FIG. 2 (A)) in which the loop shape W2 is repeatedly formed as the sustain shape portion.

When the key-off pulse signal KOFP has risen to level "1" by the key-off operation at the time point t15 in FIG. 14 during generation of the above described envelope shape of the sustain shape portion, the selection signal forming circuit 61 (FIG. 4) switches the bit outputs of the selection signal SEL to V11="1" and V10="1" in response to the rising of the key-off pulse signal KOFP. The selection mode of the selector 53 thereupon is switched to the reset mode as shown in FIG. 12 to cause the all "0" data to be written in the register 54 and thereby clear the stepping address data ADD compulsorily to all "0".

Simultaneously, in the address designation circuit 23 (FIG. 4), the bit outputs of the data selection signal AD are switched to V1="1" and Vo="0" in response to falling of the key-on signal KON to "0" level and the selection mode of the selectors 34 and 35 thereby is switched to the release mode as shown in FIG. 10.

The selector 34 thereupon is brought into the mode in which the release address data RA among the head address data FRjh (FIG. 7) provided by the head address selection register 31 is supplied as the memory address data MAD to the addition circuit 25 (FIG. 5) and the address signal S6 is changed to designate, in response to the memory address data MAD, the head address RAko of the release envelope data DRAk in the envelope shape data memory area ENVk of the envelope shape memory 21.

In addition, the selector 35 (FIG. 4) is switched to the mode in which the release size data RS among the memory size data MZjh (FIG. 8) read from the memory size selection register 32 is supplied as the memory size data MSD to the subtraction circuit 55 of the address counter 24 (FIG. 11).

At this time, the read clock data selection register 33 maintains the mode in which it continues to provide the read clock data CLjh (FIG. 9) as the read clock data RCD.

In addition to these operation, when the key-off pulse signal KOFP has risen to "1" level at the time point t15 of FIG. 14, the bit data of the control signal KON supplied to the selector 73 of the envelope shape generation circuit 5 (FIG. 3) becomes KOFP="1" and KONP="0" and, accordingly, the selection mode of the selector 73 is switched to the load mode as shown in FIG. 13.

The selector 73 thereupon performs the operation for loading the envelope shape readout signal S7 which has been read from the envelope shape memory 21 into the register 74.

The value of the envelope shape readout signal S13 which is loaded at this time into the register 74 through the selector 73 is data immediately before the time point t15 among the loop envelope data DLAk (FIG. 5) which has been read from the envelope shape memory 21 for forming the loop shape before the time point t15. Accordingly, the envelope shape value of the connection shape W2X (FIG. 2(A)) at the time point t15 consisting of a shape formed by cutting off the loop shape W2 by the key-off operation is directly written in the register 74.

When, subsequently, the key-off pulse signal KOFP has fallen to "0" level, the bit data of the control signal CON is switched to KOFP="0" and KONP="0" and the selection mode of the selector 73 thereby is switched to the hold mode as shown in FIG. 13. The data of the register 74 therefore is held dynamically by the register 74 through the selector 73.

In the above described manner, the data held by the register 74 which constitutes the connection signal S8 is provided as the addition output S9 of the addition circuit 72 and, in response thereto, the envelope shape signal S5 changes in such a manner that the following release envelope data read out as the envelope shape readout signal S7 from the envelope shape memory 21 decays from the value of the data held by the register 74.

More specifically, when the key-off pulse signal KOFP falls to "0" level after rising to "1" level at the time point t15 in FIG. 14, the bit output of the selection signal SEL provided by the selection signal forming circuit 61 (FIG. 4) is switched to V11="0" and V10="1" in response to the memory size excess detection signal MOV and the selection mode of the selector 53 (FIG. 11) thereby is switched to the stepping mode as shown in FIG. 12.

Accordingly, the stepping address data ADD of the register 54 is incremented by one address from the state of all "0" each time the address stepping pulse INCP is generated and the release envelope data DRAk (FIG. 5) of the envelope shape memory 21 is read out sequentially by one address from the head address RAko in response to the address stepping data ADD.

Therefore, upon falling of the key-off pulse signal KOFP to "0" level, the addition output S9 which exhibits the release shape W3 (FIG. 2(A)), i.e., the envelope shape signal S5, is obtained.

In this state, the change of the data of the addition output S9 is watched by the off level detection circuit 71 and, when the value of the addition output S9 has fallen to the fadeout level (the above described dB in FIG. 2(A)), the off level detection circuit 71 supplies the level off detection signal LOF which rises to "1" level to the selection signal forming circuit 61 (FIG. 4) of the address designation circuit 23 and thereby causes the bit output of the selection signal SEL to be switched to V11="0" and V10="0".

At this time, the selection mode of the selector 53 of the address counter 24 (FIG. 11) becomes the hold mode as shown in FIG. 12 so that the stepping address data ADD at the time point when the level off detection signal LOF has been generated in the register 54 is held.

The envelope shape readout signal S7 read from the envelope shape memory 21 is fixedly held at the value at which the shape value of the addition output S9 (accordingly, the envelope shape signal S5) is 0 dB.

In the manner described with reference to the time point t7 of FIG. 2(A) above, the release shape W3 can be started always from the shape value at the end of the last loop shape W2X in the envelope shape signal S5 provided by the envelope shape generation circuit 5, regardless of the time point at which the key-off operation is made. Therefore, the release shape can be connected smoothly to the loop shape.

For achieving the above result, data for one shape only is required as the envelope shape data of the release shape W3 so that the memory capacity of the envelope shape memory can be minimized.

The above operation has been described about the case in which, as shown in FIG. 2 (A), the loop shape W2 is repeatedly generated as the sustain shape portion. In the case where the envelope shape portion is formed with the sustain shape W4 of a constant level as shown in FIG. 2(F), the sustain select signal SUS of the sustain select signal generation circuit 11 is switched to "0" level by operating the sustain shape selection operator 13.

In this case, upon depression of a key in the keyboard 2, the address designation circuit 23 and the address counter 24 are operated to generate the attack shape W1 (FIG. 2 (F)) in the same manner as has been described with respect to the time points t11 to t12 of FIG. 14. By first occurrence of the memory size excess detection signal MOV of "1" level in the subtraction circuit 55 of the address counter (FIG. 11) at the time point t12, the flip-flop circuit 39 performs a set operation in the data selection signal forming circuit 36 of the address designation circuit 23 (FIG. 4) and the selectors 34 and 35 are thereby switched to the loop mode. In this state, since the sustain select signal SUS is "0", the bit outputs of the selection signal SEL provided by the selection signal forming circuit 61 become V11="0" and V10="0" so that the selector 53 of the address counter 24 is controlled in a manner different from the case of forming the loop shape W2.

More specifically, the selection mode of the selector 53 is switched to the hold mode shown in FIG. 12 and data of the register 54 (i.e., difference data written in the return mode) is stored dynamically through the selector 53 and the stepping address data ADD is thereby held at a constant value, remaining as the difference data.

Accordingly, data stored at an address which has stepped from the head address LAko in the loop envelope data DLAk (FIG. 5) by addresses corresponding to the difference data is read as the envelope readout signal S7 from the envelope shape memory 21 (FIG. 3).

In this manner, the envelope shape signal S5 is held at the value by which the envelope shape is fixed until the key-off operation is made.

When the key-off operation has been made at the time point t15 in this state, the key-off pulse signal KOFP is generated and the bit outputs of the selection signal SEL provided by the selection signal forming circuit 61 become V11="1" and V10="1". The selection mode of the selector 53 (FIG. 11) thereby is switched to the reset mode as shown in FIG. 12 so that, in the same manner as has been described with reference to FIG. 2(A), the stepping address data ADD of the register 54 is cleared to all "0".

Simultaneously, the bit outputs of the control signal CON supplied to the selector 73 (FIG. 3) become KOFP="1" and KONP="0" so that the envelope shape readout signal S13 at the time point when the key-off pulse signal KOFP has been generated is held in the register 74. By adding the data of the envelope shape readout signal S7 to the connection signal S8 provided by the register 74 in the addition circuit 72, the shape value of the envelope shape signal S5 is decayed by the release envelope data DRAk of the envelope shape memory 21 (FIG. 5).

Thus, when the sustain select signal SUS is at "0" level, the shape value at which the attack shape W1 has finished is maintained after the end of the attack shape W1 as shown in FIG. 2(F) whereby there is provided the envelope shape in which the sustain shape portion is formed with the constant shape W4 and the release shape W3 decays from the shape value level of the sustain shape portion at the timing of key-off.

According to the above embodiment, the release shape W3 which is continuously connected to and decays from the envelope shape value at the time point of key-off of the sustain shape portion, i.e., the loop shape W2 or the constant value shape W4 can be formed. For forming such release shape, envelope data for one shape has only to be prepared as the release shape W3 regardless of the value of the shape at the time point of key-off. Accordingly, a smooth envelope shape can be generated without complicating the structure of the envelope shape memory 21.

As shown in FIG. 15, when the key-off operation has been made at a desired time point $t_{OF1}$, $t_{OF2}$, $t_{OF3}$, . . . , of the loop shape W2X, the release envelope shape data DRAk forming the release shape W3 is formed so that it decays from the envelope data DLAk1, DLAk2, DLAk3 . . . of the loop shape W2X at the time points $t_{OF1}$, $t_{OF2}$, $t_{OF3}$, . . . whereby the release shape W3 is connected smoothly to the end shape of the loop shape W2X.

According to the above described construction, in reading out the envelope shape data stored in the envelope shape memory 21, the touch data TD is used in addition to the tone color selection signal TC so that a tone with an envelope which subtly changes in accordance with the amount of touch by the player can be readily realized.

[4] Other embodiments (1) In the above described embodiments, sampling shape values are directly stored in the envelope shape memory 21 as the envelope shape data. The benefits of the invention can be obtained by storing difference data or compressed data of sampling shape values.

(2) In the above described embodiments, the attack envelope data DAAk, loop envelope data DLAk and release envelope data DRAk are stored for each envelope shape data memory area ENVk (k=1 to K) of the envelope shape memory 21 so that the attack envelope shape, loop envelope shape and release envelope shape respectively for one shape are stored with addresses of this order in each envelope shape data memory area ENVk. The order of storing the attack, loop and release envelope data is not limited to this but the order may be changed as required.

An arrangement may be made in such a manner that one or two of the attack envelope data DAAk, loop envelope data DLAk and release envelope data DRAk are not stored in each envelope shape data memory area ENVk but data which is stored in other envelope shape data memory area ENVk is read out and used (if similar envelope shape is stored).

Instead of storing the attack envelope data DAAk, loop envelope data DLAk and release envelope data DRAk respectively for one shape in each envelope shape data memory area ENVk, a part of one shape of these data may be stored and a complete attack shape, loop shape or release shape may be formed by reading out this partial shape and assembling it with other partial shape stored in other envelope shape data memory area.

(3) In the above described embodiment, the initial touch data TD is employed in addition to the tone color selection signal TC for selectively designating data in the head address selection register 31, memory size selection register 32 and read clock data selection register 33. Alternatively, data which can be selected by after-touch data may be prestored in addition to the initial touch data TD and the envelope shape may be switched on real time basis when an after-touch operation has been made after the initial touch operation.

(4) In the above described embodiment, the envelope shape having the sustain shape section and release shape section following the attack shape section is employed. The invention however is applicable to all cases where a release shape having the same envelope shape value as the envelope shape value at the end of a preceding envelope shape is connected to the preceding envelope shape, such as where a release shape section is connected directly to an attack shape section in an envelope shape having no sustain shape section.

(5) In the above described embodiment, the invention is applied to the case where the envelope shape of a sustained tone is employed. The invention however is applicable also to a case where, in realizing an envelope of a decaying tone with plural decay stages, these plural decay stages are connected one by one.

What is claimed is:

1. An envelope shape generation device comprising:

envelope memory means for storing plural envelope data;

touch information generation means for generating touch information;

address signal generation means for generating an address signal based on said touch information generated by said touch information generation means, said address signal generation means including:

address designation means, responsive to the touch information, for generating address data designating a head address of a memory storing a set of envelope data in said envelope memory;

address counter means for generating address stepping data which increments by one address in response to a clock signal; and addition means for adding the address data and the address stepping data together and supplying the result of the addition to said envelope memory as an address signal for accessing said envelope memory; and envelope data reading means for selectively reading out the envelope data stored in said envelope memory means in response to said address signal to form an envelope shape signal.

2. An envelope shape generation device comprising:

envelope memory means for storing plural envelope data;

touch information generation means for generating touch information;

address signal generation means for generating an address signal based on said touch information generated by said touch information generation means; and envelope data reading means for selectively reading out the envelope data stored in said envelope memory means in response to said address signal to form an envelope shape signal, said envelope data reading means reads out one of said plural envelope shapes as a sustain envelope shape followed by an attack envelope shape, and said plurality of sustain envelope shapes further includes a loop sustain envelope shape and a fixed sustain envelope shape having a constant envelope shape value and said envelope shape reading means reads out the loop sustain envelope shape repeatedly when said envelope shape reading means has selected the loop sustain envelope shape.

3. An envelope shape generation device comprising:

envelope shape storing means for storing envelope data;

touch information generation means for generating touch information;

envelope shape reading means for reading out the envelope data stored in said envelope shape storing means, in response to the touch information generated by said touch information generation means, to form an envelope shape signal, wherein said envelope shape reading means comprises;

first envelope shape reading means for reading out a first envelope shape section from an attack envelope shape to an envelope shape value immediately before starting of a release envelope shape in response to key-on information; and second envelope shape reading means for reading out a second envelope shape section consisting of a release envelope shape following the first envelope shape section in response to key-off information; and release envelope correction means for correcting a head value of the release envelope shape having been read out by said second envelope shape reading means to agree with the envelope shape value having been read out by said first envelope shape reading means thereby to connect the second shape section smoothly to the first envelope shape section.

4. An envelope shape generation device as defined in claim 3 wherein said release envelope correction means comprises:

selector means for selecting and outputting, in response to the key-off information, the envelope shape value of the first envelope shape section immediately before starting of the release envelope shape having been read out by said first envelope shape reading means;

holding means for holding and outputting the envelope shape value provided by said selector means; and addition means for adding the envelope shape value provided by said holding means and a value of the second envelope shape section having been read out by said second envelope shape reading means.

5. An envelope shape generation device as defined in claim 3 wherein said first envelope shape reading means selectively reads out one of a plurality of envelope shapes as a sustain envelope shape following an attack envelope shape.

6. An envelope shape generation device as defined in claim 5 wherein the plurality of sustain envelope shapes include a loop sustain envelope shape and a fixed sustain envelope shape having a constant envelope shape value and said first envelope shape reading means reads out the loop sustain envelope shape repeatedly when said first envelope shape reading means has selected the loop sustain envelope shape.

* * * * *